US010652981B1

(12) United States Patent
De Cicco et al.

(10) Patent No.: US 10,652,981 B1
(45) Date of Patent: May 12, 2020

(54) METHOD FOR DRIVING A PLURALITY OF LIGHT EMITTING DIODES AND DRIVE CIRCUIT

(71) Applicant: Infineon Technologies AG, Neubiberg (DE)

(72) Inventors: Adolfo De Cicco, Castel d'Azzano (IT); Rosario Chiodo, Selvazzano Dentro (IT); Davide Ghedin, Fiesso D'artico (IT); Andrea Scenini, Montegrotto Terme (IT)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 16/595,154

(22) Filed: Oct. 7, 2019

(30) Foreign Application Priority Data

Oct. 22, 2018 (DE) ..... 10 2018 126 249

(51) Int. Cl.
*H05B 45/10* (2020.01)
*H05B 45/37* (2020.01)

(52) U.S. Cl.
CPC ..... *H05B 45/37* (2020.01); *H05B 45/10* (2020.01)

(58) Field of Classification Search
CPC .... H05B 37/02; H05B 33/08; H05B 33/0815; H05B 33/0842; H05B 33/0845; H05B 37/27; H05B 37/72
See application file for complete search history.

(56) References Cited

U.S. PATENT DOCUMENTS 8,076,869 B2 * 12/2011 Shatford ..... H05B 33/0803 315/291
2016/0309553 A1 10/2016 Kuerschner et al.

FOREIGN PATENT DOCUMENTS

DE 102005054541 A1 5/2007
DE 102008060042 A1 9/2009
DE 102013223711 A1 5/2015

OTHER PUBLICATIONS

Office Action, in the German language, from counterpart German Application No. 102018126249.3, dated Jun. 17, 2019, 4 pp.

* cited by examiner

*Primary Examiner* — Jimmy T Vu
(74) *Attorney, Agent, or Firm* — Shumaker & Sieffert, P.A.

(57) ABSTRACT

A method may include, based on a plurality of duty cycles each associated with a respective one of a plurality of LEDs, determining a first set of drive schemes such that each drive scheme is associated with a respective one of the plurality of LEDs and is dependent on the duty cycle associated with the respective one of the plurality of LEDs. The method further includes driving each of the plurality of LEDs in accordance with the associated drive scheme of the first set in at least one drive cycle. Each of the plurality of drive schemes includes one or more on-times each having a phase and a duration. The method may include driving each of the plurality of LEDs in an on-state or an off-state dependent on the respective drive scheme and determining the drive scheme dependent on the drive scheme of another one of the plurality of LEDs.

16 Claims, 9 Drawing Sheets

$PH(1)_1=0$ $T(1)_1=TON(1)$ $PH(1)_1 + T(1)_1 + TON(2) > T_{PWM}$ $PH(2)_2 = PH(1)_1+T(1)_1$ $T(2)_2 = T_{PWM} - PH(2)_2$ $PH(2)_1=0$ $T(2)_1 = TON(2)- T(2)_2$ $PH(2)_1 + T(2)_1 + TON(3) < T_{PWM}$ $PH(3)_1 = PH(2)_1+T(2)_1$ $T(3)_1 = TON(3)$

METHOD FOR DRIVING A PLURALITY OF LIGHT EMITTING DIODES AND DRIVE CIRCUIT

This Application claims priority to German Application Number 102018126249.3, filed on Oct. 22, 2018, the entire content of which is incorporated herein by reference.

This disclosure in general relates to a method for driving a plurality of light emitting diodes (LEDs) and to a drive circuit for driving a plurality of LEDs.

LEDs are widely used in various kinds of lighting applications. Some kinds of applications include a plurality of LEDs. In some applications with a plurality of LEDs such as, for example, adaptive vehicle lights it is desired to dim the LEDs individually. "To dim an LED" means to adjust the light intensity of the LED to a desired intensity value. Dimming an LED may include pulsewidth-modulated (PWM) operating the LED and adjusting a duty cycle of the PWM operation dependent on the desired light intensity. Pulsewidth-modulated (PWM) operating means operating the LED using a modulated pulse width.

According to one approach for PWM driving a plurality of LEDs, in each of a plurality of successive drive cycles, the LEDs are switched on at the beginning of the drive cycle and remain switched on as long as defined by the respective duty cycle. Driving the LEDs in this way may have the effect that an overall current received by the plurality of LEDs is zero at the end of one PWM cycle and abruptly changes at the beginning of a next drive cycle. However, abrupt changes of the overall current, that is, abrupt changes of the power consumption, are unfavourable for several reasons. For example, abrupt current changes may cause EMI (electromagnetic interferences) in supply lines to the LEDs, and require a power supply that is capable of rapidly reacting to varying power consumption.

There is therefore a need for a method for PWM driving a plurality of LEDs that avoids abrupt current changes.

One example relates to a method. The method includes, based on a plurality of duty cycles each associated with a respective one of a plurality of LEDs, determining a first set of drive schemes such that each drive scheme is associated with a respective one of the plurality of LEDs and is dependent on the duty cycle associated with the respective one of the plurality of LEDs. The method further includes driving each of the plurality of LEDs in accordance with the associated drive scheme of the first set in at least one drive cycle. Each of the plurality of drive schemes includes one or more on-times each having a phase and a duration. Driving each of the plurality of LEDs in accordance with the associated drive scheme comprises driving each of the plurality of LEDs in an on-state or an off-state dependent on the respective drive scheme, and determining the drive scheme of at least one of the plurality of LEDs comprises determining the drive scheme dependent on the drive scheme of another one of the plurality of LEDs.

Another example relates to a drive circuit. The drive circuit is configured, based on a plurality of duty cycles each associated with a respective one of a plurality of LEDs, to determine a first set of drive schemes such that each drive scheme is associated with a respective one of the plurality of LEDs and is dependent on the duty cycle associated with the respective one of the plurality of LEDs. The drive circuit is further configured, in at least one drive cycle, to drive each of the plurality of LEDs in accordance with the associated drive scheme of the first set. Each of the plurality of drive schemes includes one or more on-times each having a phase and a duration. Driving each of the plurality of LEDs in accordance with the associated drive scheme comprises driving each of the plurality of LEDs in an on-state or an off-state dependent on the respective drive scheme, and determining the drive scheme of at least one of the plurality of LEDs comprises determining the drive scheme dependent on the drive scheme of another one of the plurality of LEDs.

Examples are explained below with reference to the drawings. The drawings serve to illustrate certain principles, so that only aspects necessary for understanding these principles are illustrated. The drawings are not to scale. In the drawings the same reference characters denote like features.

FIG. 1 schematically illustrates a circuit arrangement with a plurality of light emitting diodes (LEDs), a power supply, and a controller configured to control operation of the LEDs;

In the following detailed description, reference is made to the accompanying drawings. The drawings form a part of the description and for the purpose of illustration show examples of how the invention may be used and implemented. It is to be understood that the features of the various embodiments described herein may be combined with each other, unless specifically noted otherwise.

Figure 1:
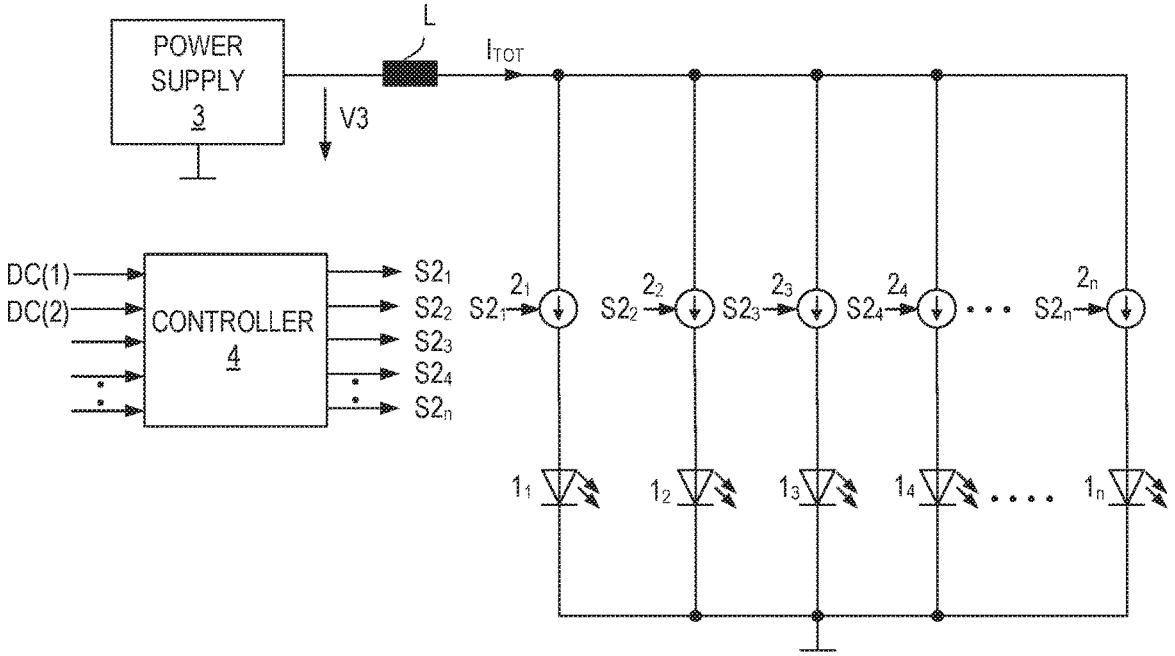

FIG. 1 schematically illustrates a circuit arrangement with a plurality of LEDs $\mathbf{1}_1$-$\mathbf{1}_n$ and a drive circuit configured to drive the plurality of LEDs $\mathbf{1}_1$-$\mathbf{1}_n$. The drive circuit includes a plurality of current sources $\mathbf{2}_1$-$\mathbf{2}_n$ wherein each of these current sources $\mathbf{2}_1$-$\mathbf{2}_n$ is connected in series with a respective one of the plurality of LEDs $\mathbf{1}_1$-$\mathbf{1}_n$. A power supply 3 is configured to generate a supply voltage V3, wherein the supply voltage V3 is received by a plurality of series circuits each including one of the plurality of LEDs $\mathbf{1}_1$-$\mathbf{1}_n$ and the respective current source $\mathbf{2}_1$-$\mathbf{2}_n$.

In the circuit arrangement illustrated in FIG. 1, the LEDs $\mathbf{1}_1$-$\mathbf{1}n$ can be activated and deactivated independently from each other. "Activating one LED" includes driving a current by the current source connected in series with the respective LED through the LED such that the LED lights up (emits light). "Deactivating one LED" includes interrupting a current flow through the LED by the respective current source.

In the example illustrated in FIG. 1, activating one of the plurality of LEDs $\mathbf{1}_1$-$\mathbf{1}_n$ includes activating the current source $\mathbf{2}_1$-$\mathbf{2}_n$ connected in series with the respective LED by a respective control signal $S\mathbf{2}_1$-$S\mathbf{2}_n$ received from a controller 4. Equivalently, deactivating one of the plurality of LEDs $\mathbf{1}_1$-$\mathbf{1}_n$ includes deactivating the current source connected in series with the respective LED by the control signal $S\mathbf{2}_1$-$S\mathbf{2}_n$. According to one example, each of the current sources $\mathbf{2}_1$-$\mathbf{2}_n$ is configured to provide a current to the LED connected in series thereto such that the current has an on-level when the respective control signal $S\mathbf{2}_1$-$S\mathbf{2}_n$ activates the current source $\mathbf{2}_1$-$\mathbf{2}_n$ and an off-level when the respective control signal $S\mathbf{2}_1$-$S\mathbf{2}_n$ deactivates the current source $\mathbf{2}_1$-$\mathbf{2}_n$. According to one example, the on-level is selected such that it causes a respective LED to light up, and the off-level is such that it causes a respective LED not to light up. According to one example, the on-level is selected from between 3 milliamperes (mA) and 25 mA, in particular between 3 mA and 15 mA. According to one example, the off-level is zero.

Figure 2A:
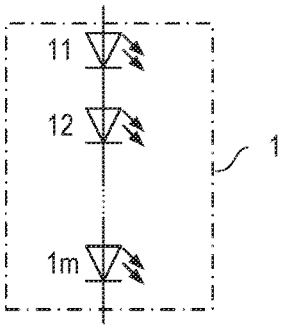
FIGS. 2A and 2B illustrate different examples of how each of the LEDs illustrated in FIG. 1 may be implemented.
Figure 2B:
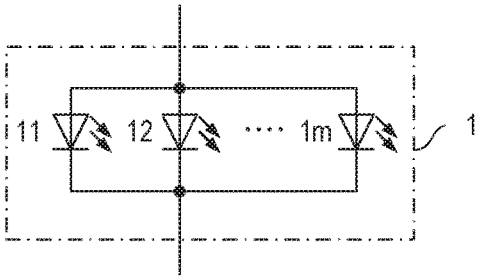

Although FIG. 1 shows one LED $\mathbf{1}_1$-$\mathbf{1}_n$ connected in series with each of the plurality of current source $\mathbf{2}_1$-$\mathbf{2}_n$ this is only an example. As used herein, an LED connected in series with one current source may include exactly one LED connected in series with current source, as illustrated in FIG. 1. However, referring to FIG. 2A it is also possible that a series circuit with several LEDs 11-1*m* is connected in series with one current source. Further, referring to FIG. 2B, a parallel circuit with several LEDs 11, 12, 1*m* can be connected in series with one current source. Thus, in the following, "LED connected in series with one current source" may include a single LED, a series circuit with several LEDs, a parallel circuit with several LEDs, or a parallel circuit including several series circuits (not shown) connected in series with one current source.

Figure 3:
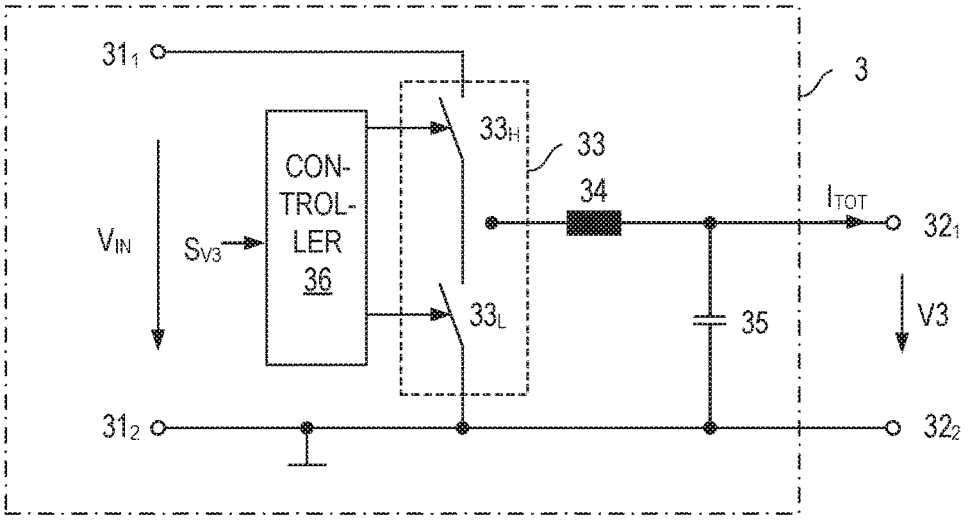
FIG. 3 illustrates one example of a power supply implemented as a buck converter.

The power supply 3 is only schematically illustrated in FIG. 1. According to one example the power supply 3 is a buck converter. One example of a power supply 3 implemented as a buck converter is illustrated in FIG. 3. Referring to FIG. 3, the buck converter includes a half bridge 33 with a high side switch $\mathbf{33}_H$ and a low side switch $\mathbf{33}_L$ connected in series. The half bridge 33 is connected between input nodes $\mathbf{31}_1$, $\mathbf{31}_2$ that are configured to receive an input voltage $V_{IN}$. A series circuit with an inductor 34 and a capacitor 35 is connected in parallel with the low side switch $\mathbf{33}_L$, wherein the supply voltage V3 is available between output nodes $\mathbf{32}_1$, $\mathbf{32}_2$ that are connected to the output capacitor 35. A controller 36 receives an output voltage signal $S_{V3}$ that represents the output voltage V3 and is configured to control operation of the half bridge 33 such that the output voltage V3 has a predefined voltage level. The output voltage signal $S_{V3}$ can be generated by any kind of voltage measurement circuit (not shown in FIG. 3).

An LED can be dimmed, that is, the light intensity of light emitted by an LED can be varied by PWM driving the LED in a plurality of successive drive cycles (PWM cycles). "PWM driving an LED" includes switching on the LED for a predefined time period in each drive cycle and switching off the LED for the remainder of the drive cycle. A PWM frequency, which is the frequency at which the individual drives cycles occur, is usually higher than 60 Hz, or even higher than 100 Hz so that the switching operation is not visible to the human eye. What is seen by the human eye is a varying light intensity of the LED, wherein the light intensity decreases as a duration of an on-time in each PWM cycle decreases. The "on-time" is the time for which the LED is switched on during one PWM cycle. Usually, the on-time is defined by a duty cycle, which defines the ratio between the duration of the on-time and the duration of one PWM cycle, that is, $DC=TON/T_{PWM}$ wherein DC is the duty cycle, TON is the duration of the on-time and $T_{PWM}$ is the duration of one drive cycle.

Figure 4A:
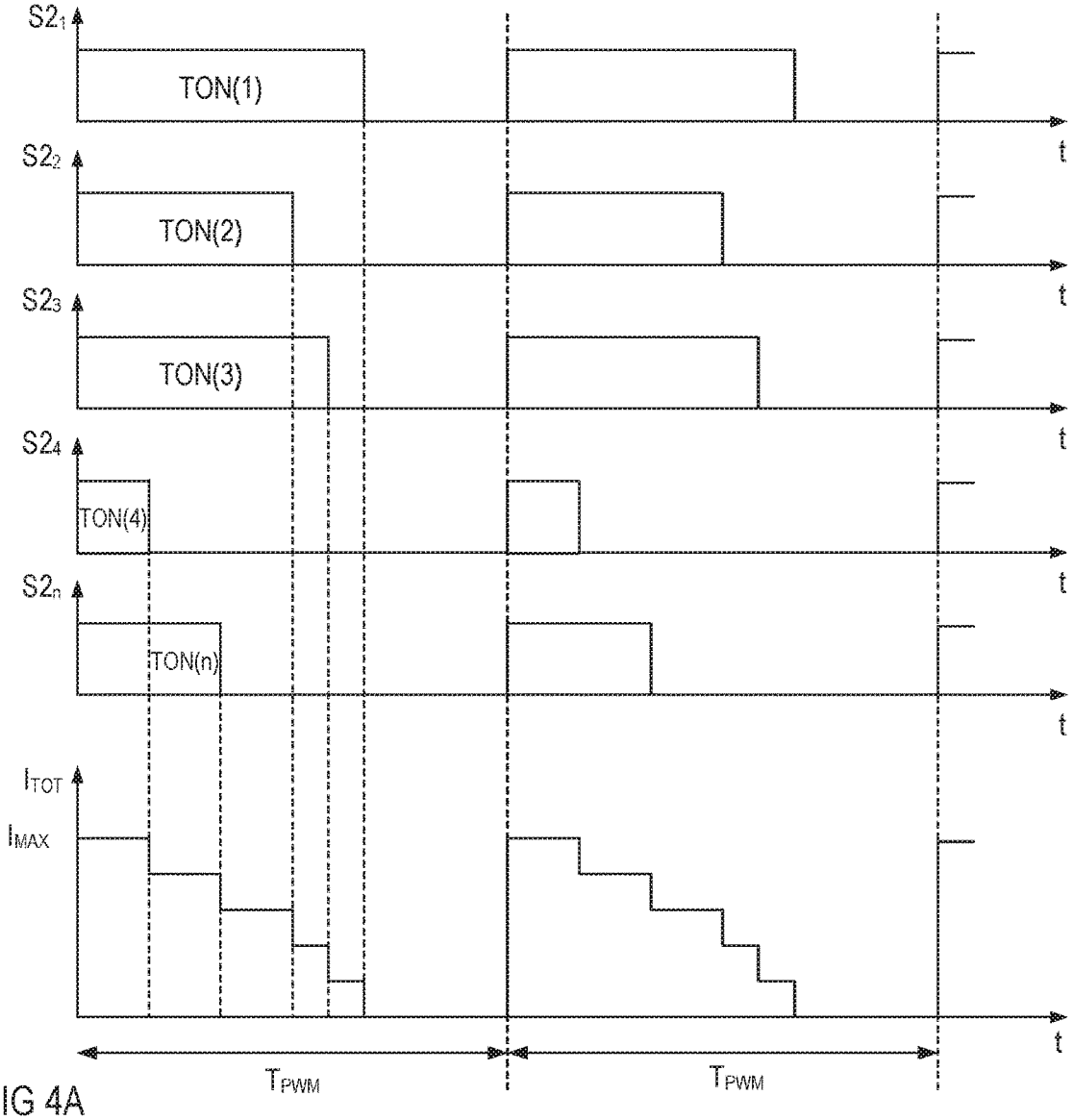
FIGS. 4A and 4B illustrate two conventional methods for pulsewidth-modulated (PWM) driving the plurality of LEDs.

FIG. 4A illustrates a conventional method for PWM driving a plurality of LEDs. More specifically, FIG. 4A illustrates drive signals $S\mathbf{2}_1$-$S\mathbf{2}_n$ received by the current sources $\mathbf{2}_1$-$\mathbf{2}_n$ and an overall current $I_{TOT}$ in this method. Each of the control signals $S\mathbf{2}_1$-$S\mathbf{2}_n$ can have a first signal level, which is also referred to as activation level in the following, and a second signal level, which is also referred to as second signal level in the following. The activation level of one drive signal activates the respective current source so that the LED connected in series lights up and the deactivation level deactivates the respective current source so that the LED connected in series switches off. Just for the purpose of illustration, the activation level is a high signal level and the deactivation level is a low signal level in the example illustrated in FIG. 4A. FIG. 4A illustrates driving the LEDs in two successive drive cycles each having the same duration $T_{PWM}$. The PWM frequency $f_{PWM}$ is given by the reciprocal of this duration $T_{PWM}$, that is, $f_{PWM}=1/T_{PWM}$.

In the example illustrated in FIG. 4A, the duty cycle associated with each of the LEDs is different from zero so that each of the current sources $\mathbf{2}_1$-$\mathbf{2}_n$ is activated in each PWM cycle for a predefined time period TON(i) (TON(i) denotes an arbitrary one of the on-time durations TON(1)-TON(n) illustrated in FIG. 4A). Each of the on-time durations TON(i) is dependent on the respective duty cycle DC(i) as follows, $$TON(i)=DC(i)\cdot T_{PWM} \quad (1),$$

wherein DC(i) denotes the duty cycle associated with an arbitrary one $\mathbf{1}_i$ of the plurality of LEDs $\mathbf{1}_1$-$\mathbf{1}_n$. In the example illustrated in FIG. 4A, the duty cycle associated with the different LEDs $\mathbf{1}_1$-$\mathbf{1}_n$ are different so that the on-time durations TON(1)-TON(n) for which the drive signals $S\mathbf{2}_1$-$S\mathbf{2}_n$ activate the individual current sources $\mathbf{2}_1$-$\mathbf{2}_n$ are different.

In the example illustrated in FIG. 4A PWM driving the LEDs $\mathbf{1}_1$-$\mathbf{1}_n$ includes activating each of the LEDs $\mathbf{1}_1$-$\mathbf{1}_n$ by activating the respective current source $\mathbf{2}_1$-$\mathbf{2}_n$ at the beginning of each PWM cycle and keeping each of the current sources activated for the respective on-time duration TON (1)-TON(n). Referring to FIG. 4A this has the effect that a total current $I_{TOT}$ received by the arrangement with the plurality of LEDs $\mathbf{1}_1$-$\mathbf{1}_n$ and the plurality of current sources $\mathbf{2}_1$-$\mathbf{2}_n$ abruptly changes from zero to $I_{MAX}$ at the beginning of each PWM cycle and decreases during the course of the respective PWM cycles. The maximum current $I_{MAX}$ is given by $I_{MAX}=n\cdot I_{LED}$, wherein $I_{LED}$ is the current provided by one of the plurality of current sources $\mathbf{2}_1$-$\mathbf{2}_n$ in the activated state. In general, the maximum current $I_{MAX}$ is given by the number of LEDs having a duty cycle different from zero multiplied with $I_{LED}$.

An arrangement of the type illustrated in FIG. 1 may include a significant number of LEDs such as several hundred LEDs that may be arranged in a matrix configuration. If, for example, the arrangement includes 1024 LEDs (n=1024) and the current received by each LED in the activated state is 15 mA and if each of the LEDs has a duty cycle different from zero the maximum current $I_{MAX}$ is 15,36 (=1024·15 mA) amperes (A). That is, the total current $I_{TOT}$ abruptly changes from zero to 15,36 A at the beginning of each PWM cycle. The maximum current $I_{MAX}$ is still higher than 7.5 A when 50% of the LEDs have a duty cycle of zero. Abrupt current changes of this type are unfavorable for several reasons. (1) Large transients of the total current $I_{TOT}$ may cause voltage spikes at parasitic inductances (see L in FIG. 1) of connection lines between the power supply 3 and the arrangement with the LEDs $\mathbf{1}_1$-$\mathbf{1}_n$ and the current sources $\mathbf{2}_1$-$\mathbf{2}_n$. Such voltage spikes may cause EMI (electromagnetic interference) problems. (2) A power supply that is capable of handling such abrupt changes of the total current $I_{TOT}$ is difficult and expensive to implement.

Figure 4B:
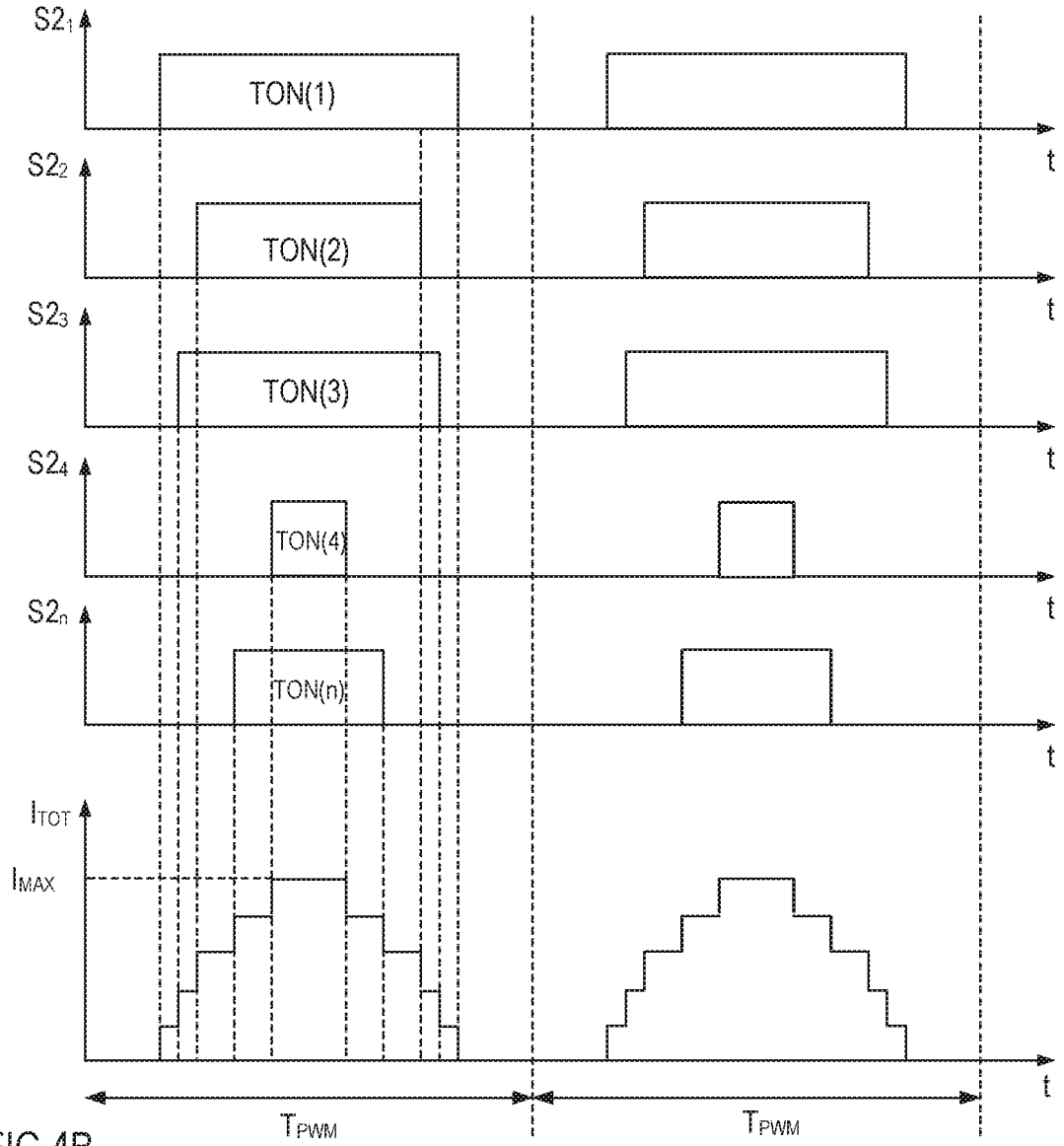

FIG. 4B illustrates another example of a conventional method for PWM driving a plurality of LEDs. In this method, each of the LEDs is activated such that a center of the respective on-time duration TON(i) is in the center of the drive cycle $T_{PWM}$. If, as given in the example illustrated in FIG. 4B, the LEDs have different duty cycles the total current $I_{TOT}$ gradually increases and gradually decreases in each drive cycle. Large and fast current transients can be avoided by this method (when the LEDs have different duty cycles). However, the maximum current $I_{MAX}$ is the same as an example shown in FIG. 4A.

Figure 5:
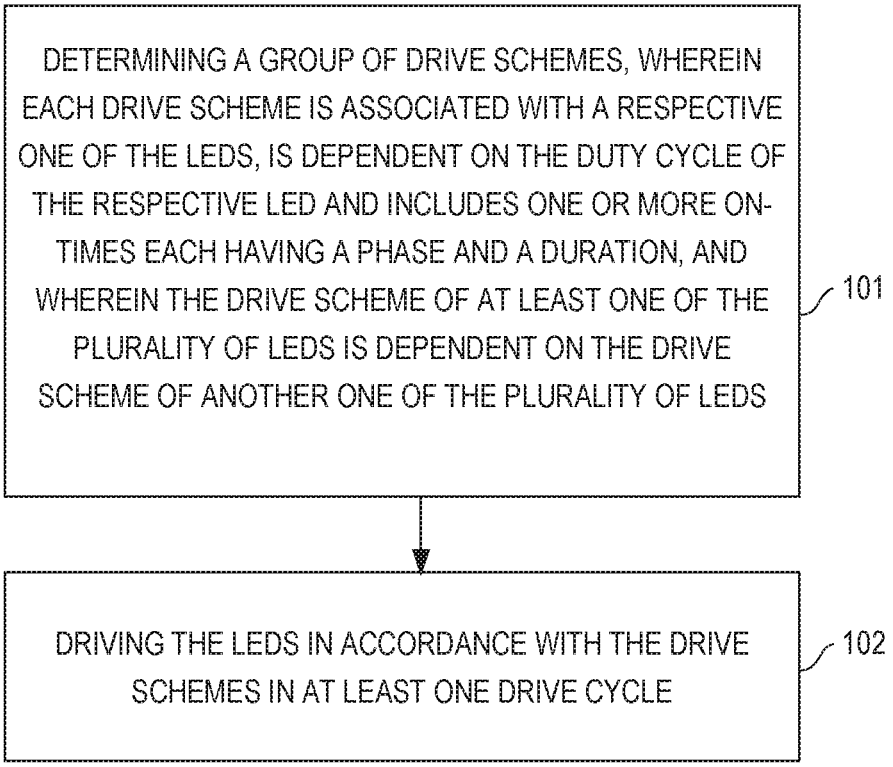
FIG. 5 illustrates a flowchart of a method according to one example.

It is desirable to avoid large and fast current transients of the total current $I_{TOT}$ and, further, to reduce the maximum current $I_{MAX}$, at least in those cases when an average duty cycle of the plurality of LEDs $\mathbf{1}_1$-$\mathbf{1}_n$ is below 1. FIG. 5 illustrates one example of a method that meets these requirements. More specifically, FIG. 5 shows a flowchart that illustrates method steps (sequences) of such method.

Referring to block 101 in FIG. 5, the method includes determining a set of drive schemes for the plurality of LEDs. Each of these drive schemes is associated with a respective one of the LEDs, is dependent on the duty cycle of the respective LED and includes one or more on-times, wherein each on-time has a phase and a duration. Further, the drive scheme of at least one of the plurality of LEDs is determined dependent on the drive scheme of another one of the plurality of LEDs. The latter is explained in further detail herein below. Referring to FIG. 5, the method further includes driving the LEDs in at least one drive cycle in accordance with the set of drive schemes. "Driving one LED in accordance with a drive scheme" includes driving the LED in accordance with the one or more on-times associated with the drive scheme. "Driving an LED in accordance with an on-time" includes switching on the LED at a time instance defined by the phase associated with the on-time and maintaining the LED in the on-state for an on-time duration associated with the on-time. The "phase" of an on-time defines a time difference between a beginning of the drive cycle and the beginning of the on-time duration.

Figure 6:
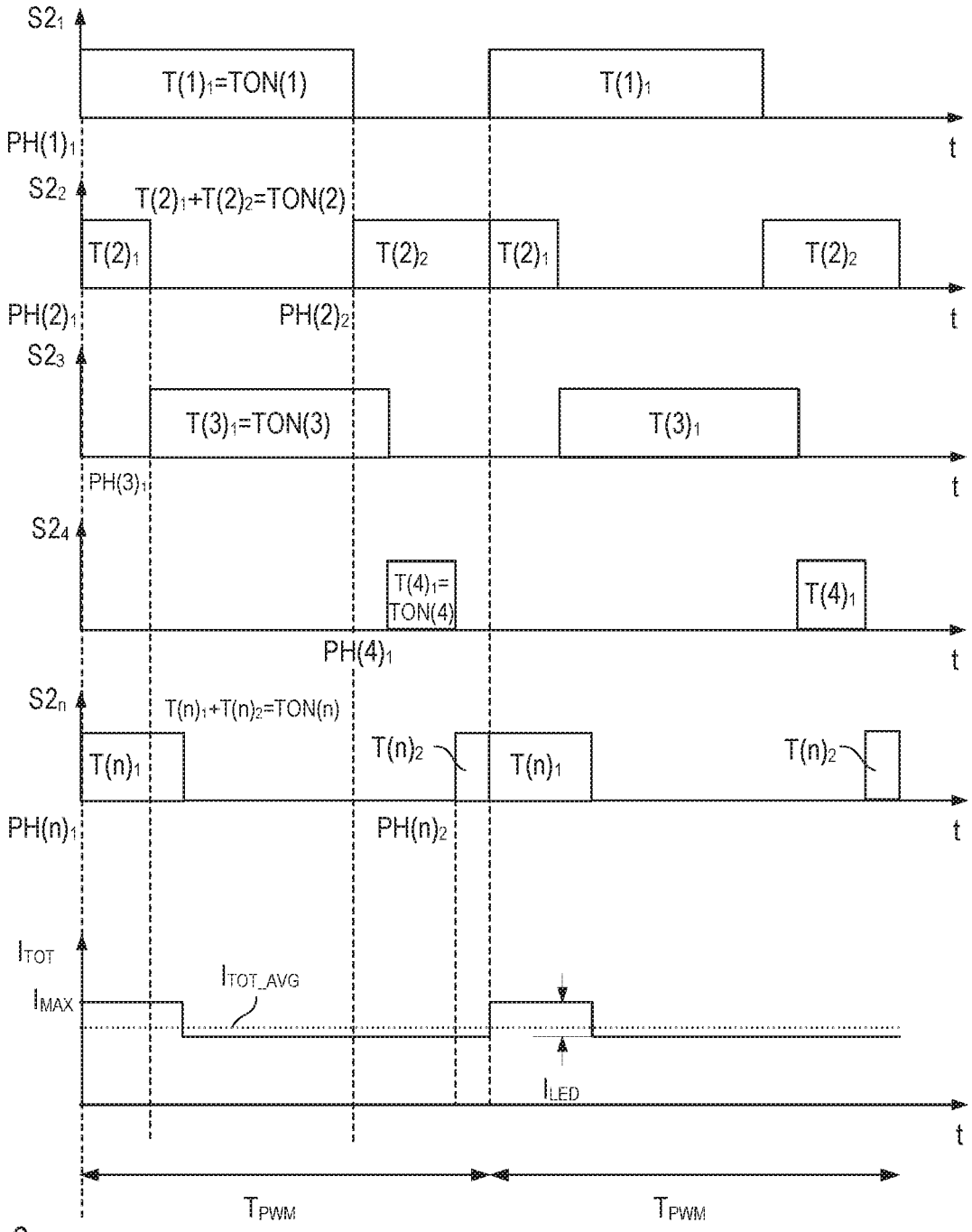
FIG. 6 illustrates drive schemes of the plurality of LEDs, wherein the drive schemes are in accordance with the method illustrated in FIG. 5.

Examples of drive schemes that have been determined based on the method according to FIG. 5 are illustrated in FIG. 6. FIG. 6 illustrates the drive schemes of n LEDs by illustrating the drive signals $S\mathbf{2}_1$-$S\mathbf{2}_n$ received by the current sources $\mathbf{2}_1$-$\mathbf{2}_n$ connected in series with the respective LEDs. In the example shown in FIG. 6, drive schemes of n=5 LEDs are illustrated. This, however, is only an example. The method can be applied to an arrangement with any number of LEDs.

In the example illustrated in FIG. 6, the drive scheme of a first LED $\mathbf{1}_1$ (as represented by drive signal $S\mathbf{2}_1$ in FIG. 6) includes a first on-time having a first phase $PH(\mathbf{1})_1$ and a first duration $T(\mathbf{1})_1$; a drive scheme of a second LED $\mathbf{1}_2$ (as represented by drive signal $S\mathbf{2}_2$ in FIG. 6) includes a first on-time with a first phase $PH(\mathbf{2})_1$ and a first duration $T(\mathbf{2})_1$ and a second on-time with a second phase $PH(\mathbf{2})_2$ and a second duration $T(\mathbf{2})_2$; a drive scheme of a third LED $\mathbf{1}_3$ (as represented by drive signal $S\mathbf{2}_3$ in FIG. 6) includes a first on-time with a first phase $PH(\mathbf{3})_1$ and a first duration $T(\mathbf{3})_1$; the drive scheme of a fourth LED $\mathbf{1}_4$ includes a first on-time with a first phase $PH(\mathbf{4})_1$ and a first duration $T(\mathbf{4})_1$; and the drive scheme of an n-th LED $\mathbf{1}_n$ (as represented by drive signal $S\mathbf{2}_n$ in FIG. 6) includes a first on-time with a first phase $PH(n)_1$ and a first duration $T(n)_1$ and a second on-time with a second phase $PH(n)_2$ and a second duration $T(n)_2$. If drive scheme of one LED includes more than one on-time (as illustrated in the drive schemes of the second LED $\mathbf{1}_2$ and the n-th LED $\mathbf{1}_n$ in FIG. 6) the phases and duration of these on-times are adapted to one another such that the on-times do not overlap. That is, between the two on-times there is a time period in which the respective LED is in the off-state. The overall duration TON(i) of the one or more on-times of one LED is dependent on the respective duty cycle DC(i) such that the overall duration equals $DC(i)\cdot T_{PWM}$ ($TON(i)=DC(i)\cdot T_{PWM}$). The overall duration TON(i) is given by the sum of the durations of the one or more on-times of associated with one LED $\mathbf{1}_i$.

By suitably determining the drive schemes of the individual LEDs $\mathbf{1}_1$-$\mathbf{1}_n$ dependent on the respective duty cycles DC(1)-DC(n), the total current $I_{TOT}$ can be shaped. That is, by suitably selecting the phases and the durations of the one or more on-times associated with the respective LEDs, the total current $I_{TOT}$ can be shaped. In the example illustrated in FIG. 6, the individual drive schemes have been determined such that throughout the drive cycle at least a predefined number of LEDs is switched on at the same time. According to one example, the predefined number of LEDs that are at least switched on at the same time is given by $int(DC_{AVG}\cdot n)$, where $DC_{AVG}$ is the average duty cycle and int(·) is the integer value of (·). The average duty cycle $DC_{AVG}$ is given by $$DC_{AVG} = \frac{\sum_{i=1}^{n} DC(i)}{n}, \tag{2}$$

where n is the overall number of LEDs. In the example illustrated in FIG. 6, the duty cycles of the individual LEDs $\mathbf{1}_1$-$\mathbf{1}_n$ are such that the average duty cycle is 0.45 ($DC_{AVG}=0.45$). (In this example, DC(1)=⅔; DC(2)=½; DC(3)=7/12; DC(4)=⅙; and DC(n)=⅓.) The average duty cycle multiplied with the number of LEDs is therefore given by $$DC_{AVG}\cdot n=0.45\cdot 5=2.25.$$

Thus, $int(DC_{AVG}\cdot n)=2$ in this example. That is, in the example illustrated in FIG. 6, at least two (2) LEDs are switched on at the same time throughout the drive cycle. Further, in this example, because $DC_{AVG}\cdot n$ is greater than $int(DC_{AVG}\cdot n)$, there is a time period within the drive cycle in which the predefined number plus one LEDs are switched on at the same time, that is, $int(DC_{AVG}\cdot n)+1(=3)$ LEDs are switched on at the same time. A duration of this time period is given by $$(DC_{AVG}\cdot n-int(DC_{AVG}\cdot n))\cdot T_{PWM}.$$

In the example illustrated in FIG. 6, this time period in which one more than the predefined number of LEDs is switched on is $0.25\cdot T_{PWM}$ ($=(2.25-2)\cdot T_{PWM}$). Just for the purpose of illustration, this time period is at the beginning of the drive cycles $T_{PWM}$.

Further, in the example illustrated in FIG. 6, the maximum current $I_{MAX}$ is dependent on the average duty cycle. More specifically, the maximum current ist given by $(int(DC_{AVG}\cdot n)+1)\cdot I_{LED}$, which is significantly lower than in the conventional methods according to FIGS. 4A and 4B. In general, the maximum current is either $I_{MAX}$=int($DC_{AVG}$·n)·$I_{LED}$ (which is when $DC_{AVG}$·n is an integer) or $I_{MAX}$=(int($DC_{AVG}$·n)+1)·$I_{LED}$.

In the example illustrated in FIG. 6, either int($DC_{AVG}$·n)+1 or int($DC_{AVG}$·n) are switched on at the same time throughout each drive cycle. When the number of LEDs that are switched on at the same time changes (from int($DC_{AVG}$·n)+1 to int($DC_{AVG}$·n) or vice versa), the total current $I_{TOT}$ changes by one time $I_{LED}$. Thus, by suitably selecting the drive schemes of the individual LEDs $\mathbf{1}_1$-$\mathbf{1}_n$ the total current $I_{TOT}$ can be shaped such that a maximum change of the total current $I_{TOT}$ within one drive cycle is given by one time $I_{LED}$. In this case, at each time of the drive cycle the total current $I_{TOT}$ deviates less than one time $I_{LED}$ from an average total current $I_{TOT_AVG}$, wherein the average total current is given by $$I_{TOT_AVG}=DC_{AVG}\cdot n\cdot I_{LED} \quad (3).$$

It should be noted that driving one LED in one drive cycle in accordance with two or more on-times with a certain overall duration does not change the light intensity seen by the human eye as compared to driving the LED in accordance with only one on-time having the overall duration (if the switching frequency is higher than 60 Hz or even higher than 100 Hz). However, splitting the on-time of one or more LEDs into two or more on-times and suitably selecting the phases of each of the on-times makes it possible to shape the overall current $I_{TOT}$.

The set of drive schemes determined based on the duty cycles can be used in one drive cycle to drive the LEDs or can be used in two or more successive drive cycles to drive the LEDs. According to one example, the number of drive cycles is between 2 and 16. According to one example, the number of drive cycles is a multiple of 2, so that, for example, the number of drive cycles is 2, 4, 8, or 16. That is, a new set of drive schemes can be determined based on the duty cycles before each drive cycle, or a new set of drive schemes can be determined before several successive drive cycles and be used to drive the LEDs in these several successive drive cycles. In the example illustrated in FIG. 6 it is assumed that the same set of drive schemes is used in at least two successive drive cycles. As can be seen from FIG. 6, the total current $I_{TOT}$ only changes by one time $I_{LED}$ between these two drive cycles. In general, the maximum change of the total current $I_{TOT}$ between two successive drive cycles that use the same set of drive schemes is $I_{LED}$. Moreover, when $DC_{AVG}$·n=int($DC_{AVG}$·n) (that is, when $DC_{AVG}$·n is an integer) the total current $I_{TOT}$ is essentially constant throughout the successive drive cycles that use the same set of drive schemes.

FIGS. 7A to 7D illustrate one example of a method for determining the drive schemes illustrated in FIG. 6. This method includes defining an order of the LEDs $\mathbf{1}_1$-$\mathbf{1}_n$ and determining the drive schemes of the individual LEDs in this order. Just for the purpose of illustration, the order, in which the drive schemes of the individual LEDs $\mathbf{1}_1$-$\mathbf{1}_n$ are obtained in the method illustrated in FIGS. 7A to 7D is $\mathbf{1}_1$-$\mathbf{1}_2$-$\mathbf{1}_3$-$\mathbf{1}_4$-$\mathbf{1}_n$. This order can be an arbitrary order and, for example, be dependent on a position of the LEDs in the arrangement. In this case, the order is fixed. According to another example, the order reflects the duty cycle and starts with the LED having the largest duty cycle or the smallest duty cycle. In this example, the order may change each time a new set of drive schemes is determined.

In the example illustrated in FIGS. 7A to 7D, determining the drive schemes of the individual LEDs $\mathbf{1}_1$-$\mathbf{1}_n$ is equivalent to distributing the on-time durations TON(i) of the individual LEDs over several time frames TF1-TF3 each having a duration that is equal to the duration $T_{PWM}$ of one drive cycle. In this method, the drive scheme of the first LED $\mathbf{1}_1$ in the order is adjusted such that this drive scheme only includes a first on-time, wherein a phase PH($\mathbf{1}$)$_1$ is zero and a duration T($\mathbf{1}$)$_1$ is equal to the overall on-time duration TON(1) as defined by the duty cycle DC(1) associated with the first LED $\mathbf{1}_1$. Driving the first LED $\mathbf{1}_1$ based on this drive scheme has the effect, that the first LED $\mathbf{1}_1$ is switched on at the beginning of the drive cycle and is maintained in the on-state for the duration T($\mathbf{1}$)$_1$ given by the duty cycle DC(1).

Figure 7A:
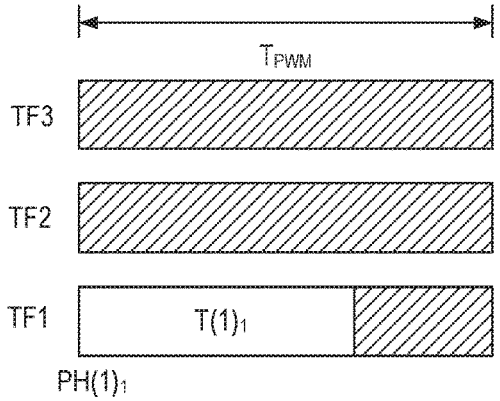
FIGS. 7A-7D illustrates one example of a method for determining the drive schemes illustrated in FIG. 6.
Figure 7B:
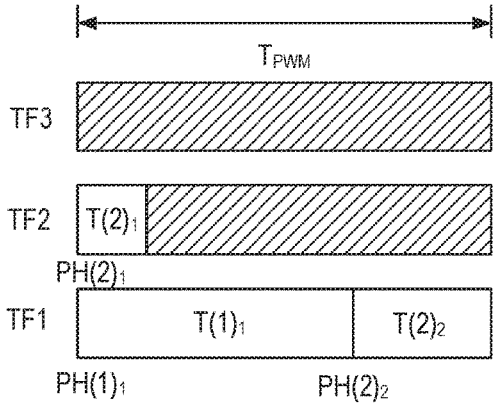

FIG. 7B illustrates determining the drive cycle of the second LED $\mathbf{1}_2$. This drive scheme is generated such that the second LED $\mathbf{1}_2$ is switched on at the same time at which the first LED $\mathbf{1}_1$ is switched off. In this example, however, a time duration between an end of the on-time duration T($\mathbf{1}$)$_1$ of the first LED $\mathbf{1}_1$ and the end of the drive cycle is too short to switch on the second LED $\mathbf{1}_2$ for the overall on-time duration TON(2) as defined by the duty cycle DC(2), that is, $$PH(1)_1+T(1)_1+TON(2)>T_{PWM}.$$

In this case, the overall on-time with the overall on-time duration TON(2) is split into two on-times, a first on-time having first phase PH($\mathbf{2}$)$_1$ and first duration T($\mathbf{2}$)$_1$ at the beginning of a second time frame TF2 and a second on-time having second phase PH($\mathbf{2}$)$_2$ and second duration T2($\mathbf{2}$)$_2$ between the on-time of the first LED $\mathbf{1}_1$ and the end of the first time frame TF1. The second phase PH($\mathbf{2}$)$_2$ is given by PH($\mathbf{2}$)$_2$=PH($\mathbf{1}$)$_1$+T($\mathbf{1}$)$_1$ so that the drive scheme of the second LED $\mathbf{1}_2$ is dependent on the drive scheme of the first LED $\mathbf{1}_1$. The second duration T($\mathbf{2}$)$_2$ is given by T($\mathbf{2}$)$_2$=$T_{PWM}$−PH($\mathbf{2}$)$_2$. Further, the first phase PH($\mathbf{2}$)$_1$ is zero and the first duration T($\mathbf{2}$)$_1$ is given by the overall duration TON(2) minus the second duration T($\mathbf{2}$)$_2$, that is, T($\mathbf{2}$)$_1$=TON(2)−T($\mathbf{2}$)$_2$.

Figure 7C:
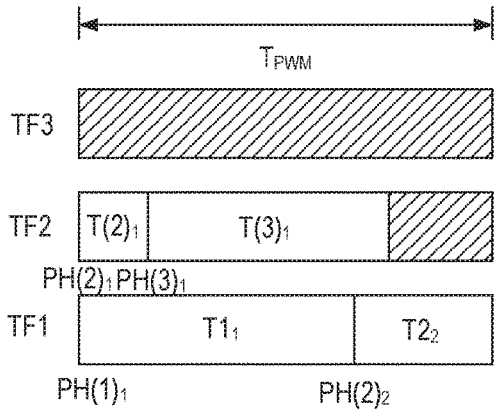

FIG. 7C illustrates determining the drive scheme of the third LED $\mathbf{1}_3$, wherein determining this drive scheme is dependent on the drive scheme of the second LED $\mathbf{1}_2$ determined beforehand. The drive scheme of the third LED $\mathbf{1}_3$ is determined such that the third LED $\mathbf{1}_3$ switches on when the second LED $\mathbf{1}_2$, based on the first on-time (having phase PH($\mathbf{2}$)$_1$ and duration T($\mathbf{2}$)$_1$), switches off. In this example, a time duration between the end of the first on-time of the second LED $\mathbf{1}_2$ and the end of the second time frame TF2 is longer than the overall duration TON(3) of the third LED $\mathbf{1}_3$ as defined by the duty cycle DC(3), that is PH($\mathbf{2}$)$_1$+T($\mathbf{2}$)$_1$+TON(3)<$T_{PWM}$. In this case, the drive scheme of the third LED $\mathbf{1}_3$ only includes a first on-time, wherein the phase PH($\mathbf{3}$)$_1$ of the first on-time is given by the end of the first on-time of the second LED $\mathbf{1}_2$, that is, PH($\mathbf{3}$)$_1$=PH($\mathbf{2}$)$_1$+T($\mathbf{2}$)$_1$. Further, the duration of T($\mathbf{3}$)$_1$ of the first on-time is given by the overall duration TON(3) as defined by the duty cycle DC(3), that is, T($\mathbf{3}$)$_1$=TON(3).

Figure 7D:
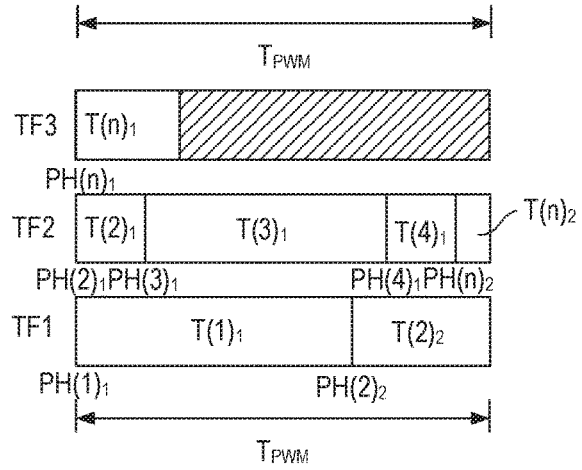

FIG. 7D illustrates generating the drive schemes of the fourth LED $\mathbf{1}_4$ and the n-th LED $\mathbf{1}_n$. In this example, the drive scheme of the fourth LED $\mathbf{1}_4$ only includes a first on-time with a first duration T($\mathbf{4}$)$_1$ given by the overall duration TON(4) as defined by the duty cycle DC(4) and a phase PH($\mathbf{4}$)$_1$ given by the end of the first duration T($\mathbf{3}$)$_1$ of the third LED $\mathbf{1}_3$. The on-time of the n-th LED is again split into two on-times, a first on-time T(n)$_1$ at the beginning of a third time frame TF3 and a second on-time with duration T(n)$_2$ between the on-time of the fourth LED $\mathbf{1}_4$ and the end of the second time frame TF2.

Figure 8:
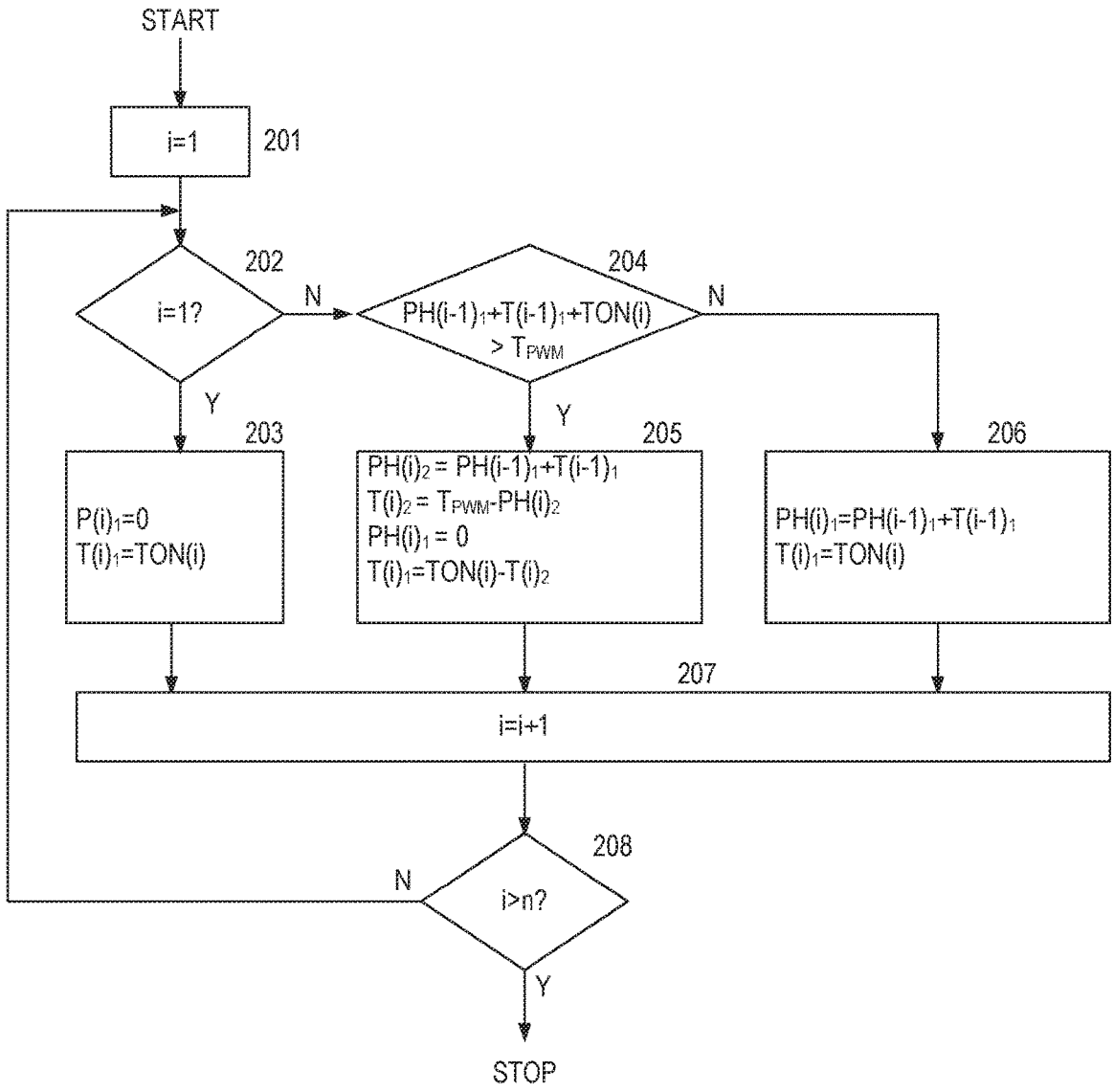
FIG. 8 shows a flowchart of the method illustrated in FIGS. 7A-7D.

FIG. 8 shows a flow chart that illustrates the method explained with reference to a specific example in FIGS. 7A to 7D in a more general way. More specifically, FIG. 8 illustrates determining the drive schemes of a plurality of LEDs one after the other. At the beginning of the process, a counter variable i is set to a predefined value, wherein the predefined value is 1 in this example (see block 201). If the counter variable is 1 (see block 202), processing proceeds to block 203 in which the drive scheme of the first LED is determined. The processing in block 203 is equivalent to the processing explained with reference to FIG. 7A. If the counter variable is different from zero, that is, if the drive scheme to be determined is not the drive scheme of the first LED, processing proceeds to block 204. In this block it is determined whether the overall time duration TON(i) as determined by the duty cycle DC(i) of the respective LED $\mathbf{1}_i$ is shorter than a time duration between an end of the first on-time duration $T(i)_1$ of the preceding LED $\mathbf{1}_{i-1}$ and the end of the drive cycle. If yes, processing proceeds to block 205 in which the on-time of LED $\mathbf{1}_i$ is split into a first on-time with a first phase $PH(i)_1$ and a first duration $T(i)_1$ and a second on-time with a second phase $PH(i)_2$ and a second duration $T(i)_2$. This processing is in accordance with the example illustrated in FIG. 7B. If the time duration between and end of the on-time duration $T(i-1)_1$ of the preceding LED $\mathbf{1}_{i-1}$ and the end of the respective time frame is shorter than the overall on-time duration TON(i) of the LED $\mathbf{1}_i$ processing proceeds to block 206 in which the drive scheme of LED $\mathbf{1}_i$ is determined such that it only includes a first on-time with a first duration $T(i)_1$ and a first phase $PH(i)_1$. This is in accordance with the example illustrated in FIG. 7C.

It should be noted that, using the method explained above, a drive scheme can be determined for each of the plurality of LEDs in the LED arrangement, even for those LEDs having a duty cycle of zero. The drive scheme of an LED with a duty cycle of zero will include a first phase and a first on-time duration of zero. However, it is also possible to apply the method only to those LEDs having a duty cycle greater than zero.

The method explained with reference to FIGS. 7A-7C and 8 is only one of several possible ways to distribute the on-time durations of a plurality of LEDs over a plurality of time frames TF1-TF3, wherein the number of time frames is $\text{int}(DC_{AVG}\cdot n)$ or $\text{int}(DC_{AVG}\cdot n)+1$ dependent on whether or not $DC_{AVG}\cdot n$ is an integer. In the methods explained above, the total current $I_{TOT}$ in each drive cycle is essentially given by the average total current as defined by equation (3) because, as explained above, the total current $I_{TOT}$ deviates by less than one time $I_{LED}$ from this average current $I_{TOT}$ AVG. Referring to the above, a new set of drive schemes may be obtained before every drive cycle or before a sequence of several drive cycles. An update of the drive schemes may cause the total current $I_{TOT}$ to change. More specifically, the total current changes when the average of the duty cycles used to determine the drive schemes before the update is different from the average of the duty cycles used to determine the drive schemes after the update. Basically, a change $\Delta I_{TOT}$ of the total current $I_{TOT}$ is approximately given by $$\Delta I_{TOT}=\Delta DC_{AVG}\cdot n\cdot I_{LED} \quad (4),$$

where $\Delta DC_{AVG}$ denotes the change of the average duty cycle. In many lighting applications that use a plurality of PWM driven LEDs the average duty cycle $D_{AVG}$ changes slowly so that that the change $\Delta I_{TOT}$ of the total current $I_{TOT}$ is moderate and acceptable in view of EMI or the like.

The set of drive schemes obtained by the method explained above is referred to as first set of drive schemes in the following. According to one example, based on the same set of duty cycles, the first set of drive schemes and a second set of drive schemes are determined, wherein the plurality of LEDs $\mathbf{1}_1$-$\mathbf{1}_n$ are driven in accordance with the second set of drive schemes in a first one of a predefined number of drive cycles and in accordance with the first set of drive schemes in the remainder of the predefined number of drive cycles. According to one example, the predefined number of drive cycles is given by $2^k$, wherein k is selected from between 1 and 4.

Each of the drive schemes of the second set is associated with a respective one of the plurality of LEDs $\mathbf{1}_1$-$\mathbf{1}_n$ and is dependent on the duty cycle DC(1)-DC(n) associated with the respective one of the plurality of LEDs $\mathbf{1}_1$-$\mathbf{1}_2$. Further, at least some of the drive schemes of the second set are dependent on a difference between an average duty cycle of the set of duty cycles and an average duty cycle of the set of previous duty cycles. "The set of previous duty cycles" is the set of duty cycles used to drive the LEDs in the drive cycle that occurs before the first drive cycle. The average duty cycle of the previous set of duty cycles is zero when the first duty cycle is a very first duty cycle after starting up the system.

Referring to the above, a difference greater than zero between the average duty cycles in two successive drive cycles may produce a step in the total current $I_{TOT}$ between the two drive cycles. According to one example, the second set of drive schemes is determined such that at the beginning of the first drive cycle the total current $I_{TOT}$ increases or decreases gradually from the current level at the end of the previous drive cycle to a current level that is dependent on the average duty cycle in the first drive cycle.

Figure 9:
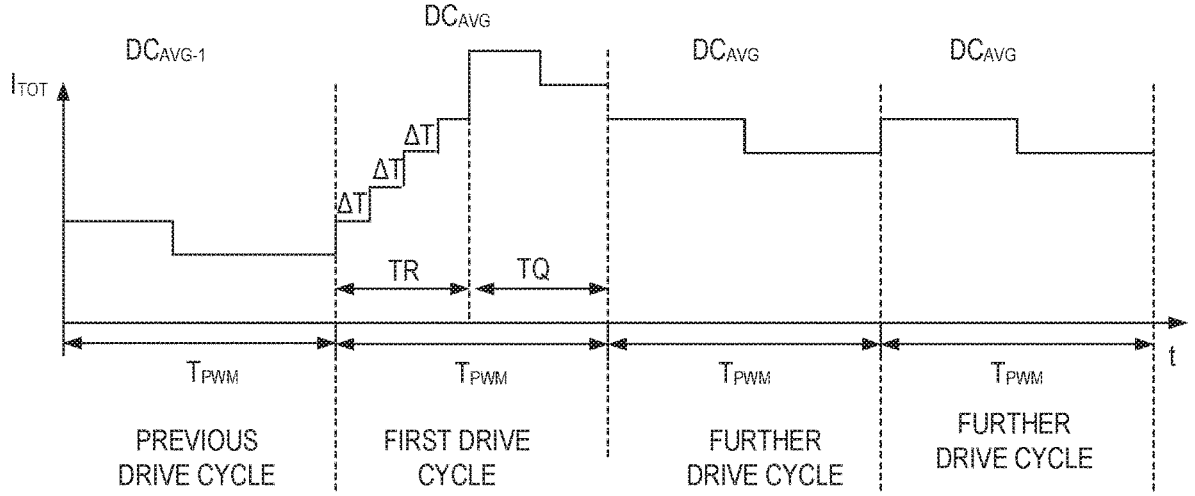
FIG. 9 illustrates another example of a method for driving a plurality of LEDs, wherein this method includes driving the LEDs based on different sets of drive schemes.

FIG. 9 schematically illustrates driving the plurality of LEDs in this way. More specifically, FIG. 9 illustrates the overall current $I_{TOT}$ when driving the plurality of LEDs (a) in the previous drive cycle based on a first set of drive schemes that has been obtained based on a first set of duty cycles having an average duty cycle $DC_{AVG-1}$, (b) in a first drive cycle of several successive drive cycles based on a second set of drive schemes that have been obtained based on a second set of duty cycles with an average duty cycle $DC_{AVG}$, and (c) in further drive cycles based on a first set of drive schemes that have been obtained based on the second set of duty cycles. The average duty cycle $DC_{AVG-1}$ in the previous drive cycle is referred to as previous average duty cycle in the following, and the average duty cycle $DC_{AVG}$ in the several successive drive cycles is referred to as actual average duty cycle in the following. In the example shown in FIG. 9, the previous average duty cycle $DC_{AVG-1}$ is lower than the actual average duty cycle $DC_{AVG}$ so that the second set of drive schemes causes a current ramp of the total current $I_{TOT}$ at the beginning of the first drive cycle. This current ramp causes the total current $I_{TOT}$ to increase in steps. The height of one step can be equivalent to a single LED current $I_{LED}$ or can be a multiple of $I_{LED}$, that is, at the beginning of the first drive cycle the number of LEDs that are switched on at the same time increases in steps of one or more than one.

The height of the individual steps and a time difference AT between the individual steps can be adjusted dependent on the average duty cycle difference. According to one example, the time difference AT decreases and/or the height of one step increases as the average duty cycle difference increases. Referring to FIG. 9, the ramp starts at a level that is given by the current level at the end of the previous drive cycle.

Figure 10:
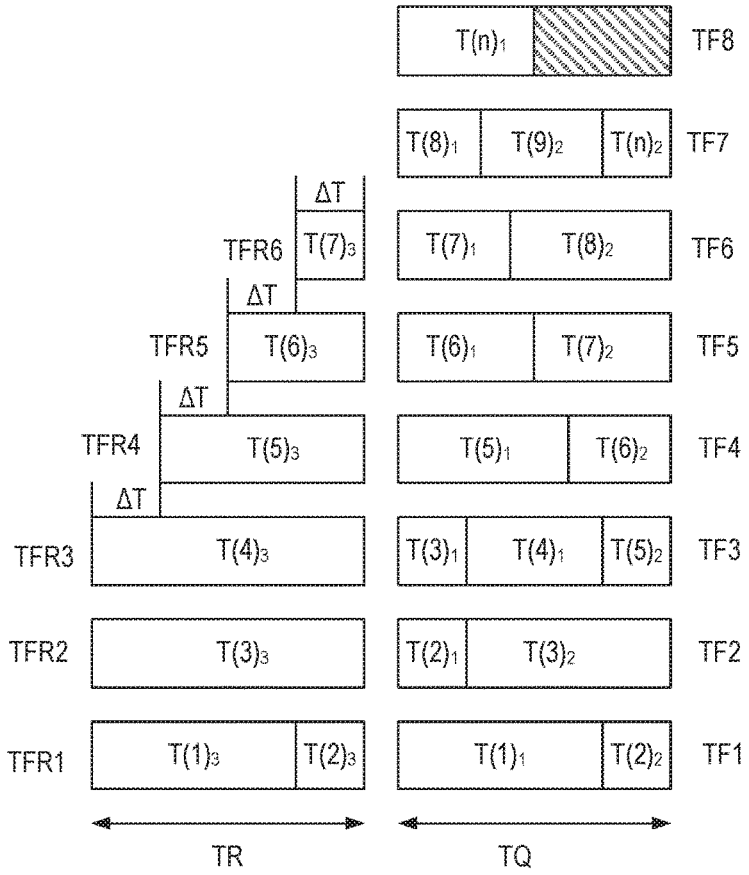
FIG. 10 illustrates one example of a method for determining one of the sets of drive schemes illustrated in FIG. 9.

FIG. 10 schematically illustrates one example for obtaining a second set of drive schemes that causes a shape of the total current $I_{TOT}$ as illustrated in the first cycle in FIG. 9. Like in the example explained with reference to FIGS. 7A-7D, the method includes defining a plurality of time frames and distributing the on-time durations TON(i) as defined by the duty cycles DC(i) over the individual time frames. In this example, the time frames include a plurality of ramp time frames TFR1-TFR6 of varying length and a plurality of further time frames TF1-TF8 of the same length TQ. FIG. 10 shows the result of distributing on-times TON(1)-TON(n) of n=10 LEDs over these time frames. The ramp time frames TFR1-TFR6 have a maximum length of TR, which is the duration of the ramp phase at the beginning of the first drive cycle. Distributing the on-times TON(1)-TON(n) over the time frames, according to one example, starts with distributing the on-time durations over the ramp time frames TFR1-TFR6.

According to one example, the overall on-times TON(1)-TON(n) are ordered according to their length and pieces $T(1)_3$-$T(7)_3$ of the longest on-durations TON(1)-TON(n) are mapped to the ramp time frames TFR1-TFR6. This, however, is only an example (as can be seen in ramp time frame TFR1).

According to one example, only one piece of a respective one of the plurality of overall on-time durations TON(1)-TON(n) is mapped to the ramp time frames TFR1-TFRn. In the example illustrated in FIG. 10, time pieces of the on-time durations TON(1)-TON(7) have been mapped to the ramp time frames TFR1-TFRn. These time pieces are referred to as $T(1)_3$-$T(7)_3$ in the example illustrated in FIG. 10.

After distributing these on-time durations $T(1)_3$-$T(7)_3$ to the ramp time frames TFR1-TFR6 residual on-time durations $TON(i)_{RES}$ remain, wherein $TON(i)_{RES}=TON(i)-T(i)_3$. These residual on-time durations and the overall on-time durations of those LEDs that have not been considered in the ramp time frames are distributed over the time frames TF1-TF8 in the same way as explained with reference to FIGS. 7A-7D and 8.

Figure 11:
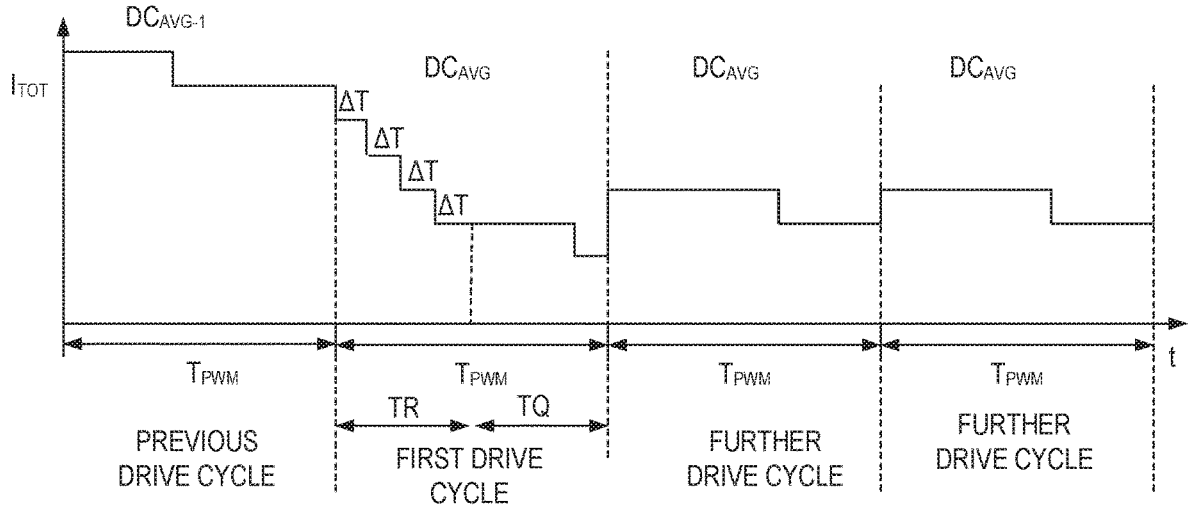
FIG. 11 illustrates another example of a method for driving a plurality of LEDs, wherein this method includes driving the LEDs based on different sets of drive schemes.
Figure 12:
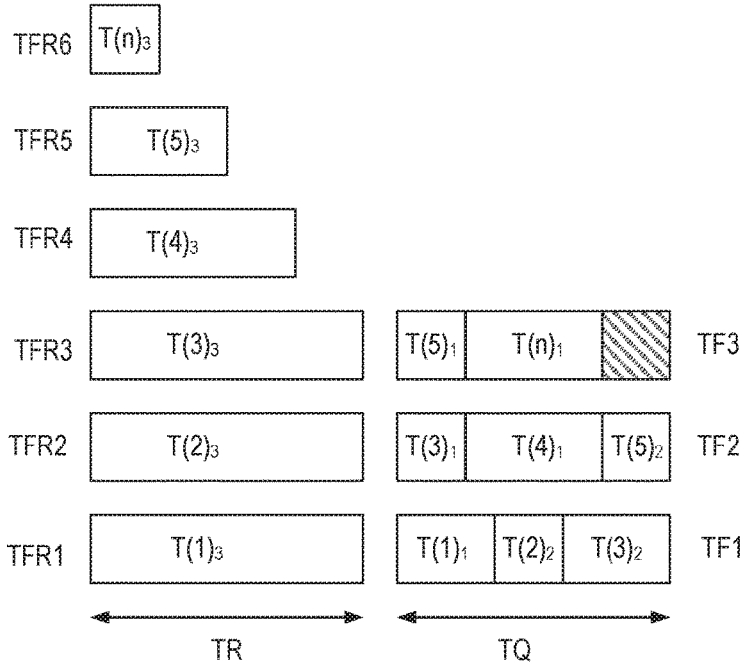
FIG. 12 illustrates one example of a method for determining one of the sets of drive schemes illustrated in FIG. 11.

FIG. 9 illustrates an example in which the average duty cycle increase so that the second set of drive schemes is such that there is a rising ramp at the beginning of the first drive cycle. FIG. 11 shows a further example. In this example, the average duty cycle decreases so that the drive schemes of the second set are generated such that there is a falling ramp at the beginning of the first drive cycle. Generating the drive schemes of the second set is graphically illustrated in FIG. 12. Like in the example shown in FIG. 10, generating the drive schemes of the second set includes distributing the overall time durations associated with the individual LEDs over ramp time frames TFR1-TFR6 with varying length and further time frame TF1-TF3 of the same length.

The method explained above for driving a plurality of LEDs can be implemented by a drive circuit as illustrated in FIG. 1, that is, a drive circuit that includes a power supply 3, a plurality of LEDs $2_1$-$2_n$ each connected in series with one of the plurality of LEDs $1_1$-$1_n$, and the controller 4. The controller 4 may receive the duty cycle information DC(1)-DC(n) and control the current through each LED $1_1$-$1_n$ by controlling the respective current source $2_1$-$2_n$. The controller may be implemented as a microcontroller and is configured to generate the drive schemes of the individual LEDs $1_1$-$1_n$ based on the received duty cycle information DC(1)-DC(n). The duty cycle information DC(1)-DC(n) may be provided by a central control unit (not shown) that governs the light intensity of the individual LEDs $1_1$-$1_n$.

FIG. 1 just illustrates a circuit diagram of the LED arrangement. According to one example, the LEDs are arranged as a matrix of, for example, 32×32 (=1024) LEDs.

While the invention has been described with reference to illustrative examples, this description is not intended to be construed in a limiting sense. Various modifications and combinations of the illustrative examples, as well as other examples of the invention, will be apparent to persons skilled in the art upon reference to the description. It is therefore intended that the appended claims encompass any such modifications or examples.

The invention claimed is:

1. A method, comprising:

based on a plurality of duty cycles each associated with a respective one of a plurality of light emitting diodes (LEDs), determining a first set of drive schemes such that each drive scheme is associated with a respective one of the plurality of LEDs and is dependent on the duty cycle associated with the respective one of the plurality of LEDs; and in at least one drive cycle, driving each of the plurality of LEDs in accordance with the associated drive scheme of the first set, wherein each of the plurality of drive schemes includes one or more on-times each having a phase and a duration, wherein driving each of the plurality of LEDs in accordance with the associated drive scheme comprises driving each of the plurality of LEDs in an on-state or an off-state dependent on the respective drive scheme, and wherein determining the drive scheme of at least one of the plurality of LEDs comprises determining the drive scheme dependent on the drive scheme of another one of the plurality of LEDs.

2. The method of claim 1, wherein determining the drive schemes of the first set comprises determining the drive schemes such that in the at least one drive cycle at least a predefined number of LEDs are driven in the on-state at the same time throughout the drive cycle.

3. The method of claim 2, wherein the predefined number of LEDs is defined according to $int(DC_{AVG} \cdot n)$, where $DC_{AVG}$ is an average duty cycle of the plurality of LEDs, n is the number of the plurality of LEDs, and $int(DC_{AVG} \cdot n)$ is the integer of $DC_{AVG} \cdot n$.

4. The method of claim 1, wherein driving the plurality of LEDs in accordance with the drive scheme of the first set in the at least one drive cycle comprises:

driving the plurality of LEDs in accordance with the drive scheme of the first set in a predefined number of successive drive cycles.

5. The method of claim 1, wherein determining the drive scheme of at least one of the plurality of LEDs dependent on a drive scheme of another one of the plurality of LEDs comprises determining the drive schemes of n−1 LEDs dependent on a drive scheme of another one of the plurality of LEDs, wherein n is either the number of the plurality of LEDs or the number of LEDs having a duty cycle different from zero.

6. The method of claim 5, wherein determining the drive schemes of the n−1 LEDs dependent on a drive scheme of another one of the plurality of LEDs comprises:

defining an order of the plurality of LEDs such that each of the n−1 LEDs has a preceding LED in the order of LEDs;

setting a drive scheme of a first LED in the order of LEDs, wherein the first LED is different from each of the n−1 LEDs; and determining the drive scheme of each of the n−1 LEDs dependent on the drive scheme of the respective preceding LED in the order of LEDs.

7. The method of claim 1, wherein determining each drive scheme such that it is dependent on the duty cycle associated with the respective one of the plurality of LEDs comprises:

determining each drive scheme such that an overall duration of the one or more on-times associated with the drive scheme is given by the respective duty cycle multiplied with a duration of the at least one drive cycle.

8. The method of claim 1, further comprising:

based on the plurality of duty cycles, determining a second set of drive schemes such that each drive scheme is associated with a respective one of the plurality of LEDs and is dependent on the duty cycle associated with the respective one of the plurality of LEDs;

driving the plurality of LEDs based on the drive schemes of the second set in a first drive cycle of a set of several successive drive; and driving the plurality of LEDs based on the drive schemes of the first set in the remainder of the several successive drive cycles, wherein at least some of the drive schemes of the second set are further determined dependent on a difference between an average of the plurality of duty cycles and an average of the plurality of duty cycles in a drive cycle preceding the first drive cycle.

9. The method of claim 8, wherein the several drive cycles comprise between 2 and 16 drive cycles.

10. A drive circuit, wherein the drive circuit is configured:

based on a plurality of duty cycles each associated with a respective one of a plurality of light emitting diodes (LEDs), to determine a first set of drive schemes such that each drive scheme is associated with a respective one of the plurality of LEDs and is dependent on the duty cycle associated with the respective one of the plurality of LEDs; and in at least one of a plurality of drive cycles, to drive each of the plurality of LEDs in accordance with the associated drive scheme of the first set, wherein each of the plurality of drive schemes includes one or more on-times each having a phase and a duration, wherein driving each of the plurality of LEDs in accordance with the associated drive scheme comprises driving each of the plurality of LEDs in an on-state or an off-state dependent on the respective drive scheme, and wherein determining the drive scheme of at least one of the plurality of LEDs comprises determining the drive scheme dependent on the drive scheme of another one of the plurality of LEDs.

11. The drive circuit of claim 10 comprising:

a power supply;

a plurality of current sources each connected in series with one of the plurality of LEDs; and a controller configured to receive the plurality of duty cycles determine the first set of drive schemes based on the plurality of duty cycles and drive the current sources based on the first set of drive schemes in order to drive the plurality of LEDs based on the first set of drive schemes.

12. The drive circuit of claim 10, wherein the drive circuit is configured to determine the drive schemes such that in the at least one drive cycle at least a predefined number of LEDs are driven in the on-state at the same time throughout the drive cycle.

13. The drive circuit of claim 12, wherein the predefined number of LEDs is $\mathrm{int}(DC_{AVG} \cdot n)$, where $DC_{AVG}$ is an average duty cycle of the plurality of LEDs, n is the number of the plurality of LEDs, and $\mathrm{int}(DC_{AVG} \cdot n)$ is the integer of $DC_{AVG} \cdot n$.

14. The drive circuit of claim 10, wherein the drive circuit is configured to drive the plurality of LEDs in accordance with the drive scheme of the first set in a predefined number of successive drive cycles.

15. The drive circuit of claim 10, wherein the drive circuit is configured to determine the drive schemes of n−1 LEDs dependent on a drive scheme of another one of the plurality of LEDs, wherein n is either the number of the plurality of LEDs or the number of LEDs having a duty cycle different from zero.

16. The drive circuit of claim 15, wherein the drive circuit is configured to determine the drive schemes of the n−1 LEDs dependent on a drive scheme of another one of the plurality of LEDs by:

defining an order of the plurality of LEDs such that each of the n−1 LEDs has a preceding LED in the order of LEDs;

setting a drive scheme of a first LED in the order of LEDs, wherein the first LED is different from each of the n−1 LEDs; and determining the drive scheme of each of the n−1 LEDs dependent on the drive scheme of the respective preceding LED in the order of LEDs.

* * * * *